United States Patent [19]

Hauptman

[11] 3,938,780

[45] Feb. 17, 1976

[54] AUTOMOBILE CHASSIS JACK

[76] Inventor: Murray L. Hauptman, 23200 Orleans Place, Southfield, Mich. 48075

[22] Filed: Feb. 21, 1974

[21] Appl. No.: 444,325

[52] U.S. Cl. ..... 254/126

[51] Int. Cl.[2] ..... B66F 3/00

[58] Field of Search ..... 254/1, 98–103, 254/124, 126, 7 R, 7 B, 7 C, 8 R, 8 B, 8 C; 214/339

[56] References Cited

UNITED STATES PATENTS

| | | | |
|---|---|---|---|
| 3,081,639 | 3/1963 | Hauptman | 214/339 |
| 3,693,937 | 9/1972 | Yamazaki | 254/126 |
| 3,746,307 | 7/1973 | Yamazaki | 254/126 |
| R26,846 | 4/1970 | Weiss | 254/1 |

FOREIGN PATENTS OR APPLICATIONS

| | | | |
|---|---|---|---|
| 854,939 | 11/1952 | Germany | 254/DIG. 1 |

*Primary Examiner*—Othell M. Simpson
*Attorney, Agent, or Firm*—Harness, Dickey & Pierce

[57] ABSTRACT

A low profile lifting device having an elongated base, a rotatable shaft extending along said base, an arm having a nut at one end threadably mounted on the shaft and a lifting pad at the other end, means at one end of the base for rotating the shaft, a pair of side levers having one end pivoted to the other end of the base and extending to a pivotal connection at an intermediate portion of the arm, and means for preventing unwanted shaft rotation in response to weight on the lifting pad.

11 Claims, 9 Drawing Figures

AUTOMOBILE CHASSIS JACK

BACKGROUND OF THE INVENTION

This invention relates to manual or motor-operated lifting devices having a low profile for lifting objects that are very close to the floor or ground, such as the frame or chassis of an automotive vehicle.

Presently, most automobile lifting devices are bumper jacks engageable with the front or rear bumper of the automobile to raise that portion of the auto by the bumper. "Scissor jacks" are also known, which are insertable beneath the car; however, this type of jack is inconvenient to position properly and is often unstable or unsafe. The present invention raises a portion of the car by contacting the frame or chassis and may be called a chassis jack.

BRIEF SUMMARY OF THE INVENTION

It is an object of the present invention to provide a novel and improved automobile chassis jack that may be used for raising a portion of an automobile from underneath the car frame in a safe, efficient and convenient manner.

It is another object of the invention to provide an automobile chassis jack of this character which is reliable in use and is relatively easy and inexpensive to manufacture.

Briefly, the illustrated embodiment of the invention comprises: a low profile lifting device having an elongated base, a rotatable shaft extending along said base, an arm having a nut at one end threadably mounted on the shaft and a lifting pad at the other end, means at one end of the base for rotating the shaft, a pair of side levers having one end pivoted to the other end of the base and extending to a pivotal connection at an intermediate portion of the arm, and means for preventing unwanted shaft rotation in response to weight on the lifting pad.

DESCRIPTION OF THE PREFERRED EMBODIMENTS

Figure 1:
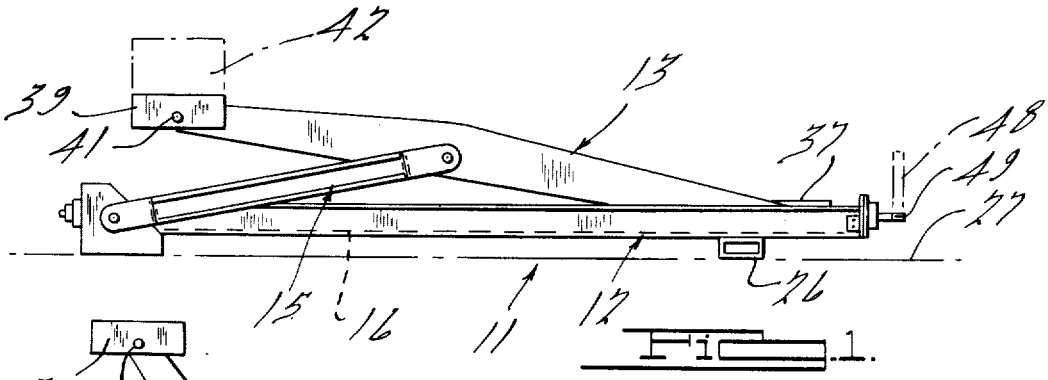
FIG. 1 is a side elevational view of the jack shown at its lowered position.
Figure 2:
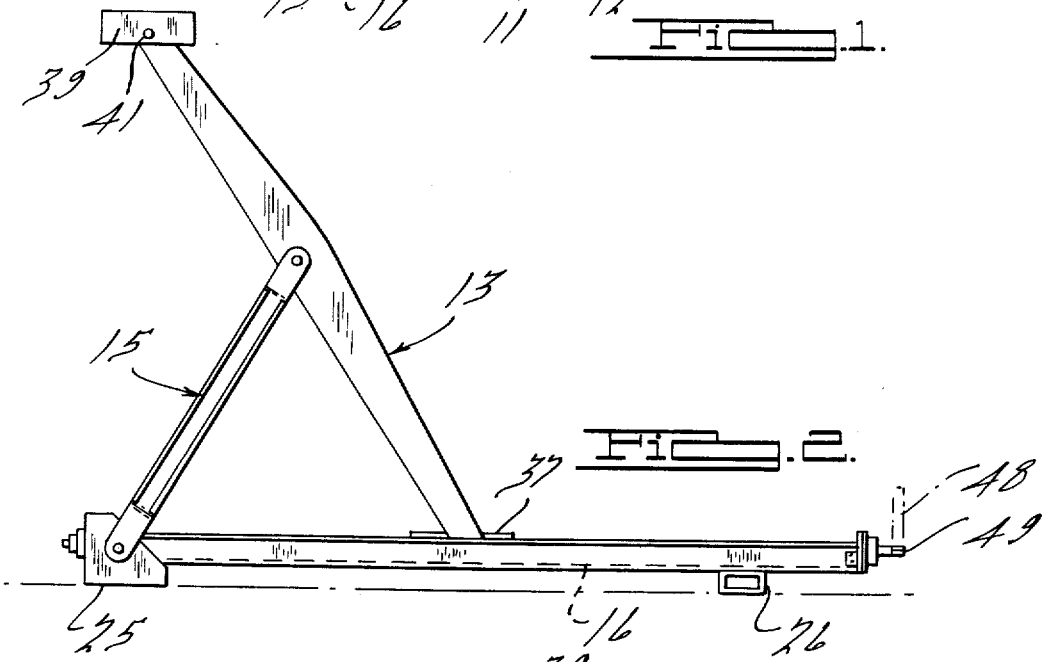
FIG. 2 is a view similar to FIG. 1 but showing the jack in its raised position.

Referring first to the embodiments of FIGS. 1 through 6, the jack is generally indicated at 11 and comprises a base generally indicated at 12, a lifting arm generally indicated at 13 and a pair of levers generally indicated at 14 and 15. The base is of elongated shape, having a channel-shaped cross section with a lower web 16, a pair of upstanding side flanges 17 and 18, and outwardly extending flanges 19 and 21. A transverse thrust plate 22 is secured to one end of base 12, the plate being wider than the base and having forwardly extending flanges 23 and 24. The underside 25 of thrust plate 22 extends below the web 16 of base 12, and a foot 26 is disposed beneath the base adjacent the forward end thereof. Underside 25 of the thrust plate and foot 26 will rest on ground 27 when the jack is being used, with base 12 horizontal.

A clutch supporting plate 28 is secured to the forward end of the base 12 and extends transversely thereacross. This plate is wider than the base and secure thereto by brackets 29 and fasteners 31. A threaded shaft 32 extends between thrust plate 22 and clutch supporting plate 28. One end 33 of this shaft extends through thrust plate 22, and a collar 34 is secured to shaft end 33 by a pin 35. This collar engages a thrust bearing 36 carried by thrust plate 22. With this arrangement, screw shaft 32 may be rotated by the hand crank means described below in order to raise or lower the load, regardless the force of the load on the screw shaft.

A nut 37 is threadably mounted on shaft 32. This nut may be of any appropriate type such as an Acme or ball nut with appropriate recirculating balls. This nut travels along the track formed by channel-shaped base 12 when the shaft is rotated.

Lifting arm 13 has one end pivotally connected at 38 to nut 37, and the other end carries a lifting pad 39 by a pivotal connection 41. Pad 39 is shown as being of inverted channel-shaped construction with an upper surface engageable with a load 42, such as the underside of the car frame. The shape of lifting arm 13 will be such as to have proper load bearing characteristics, and as shown, has its intermediate portion of greater depth than the end portions, the arm being of tapered construction.

Figure 3:
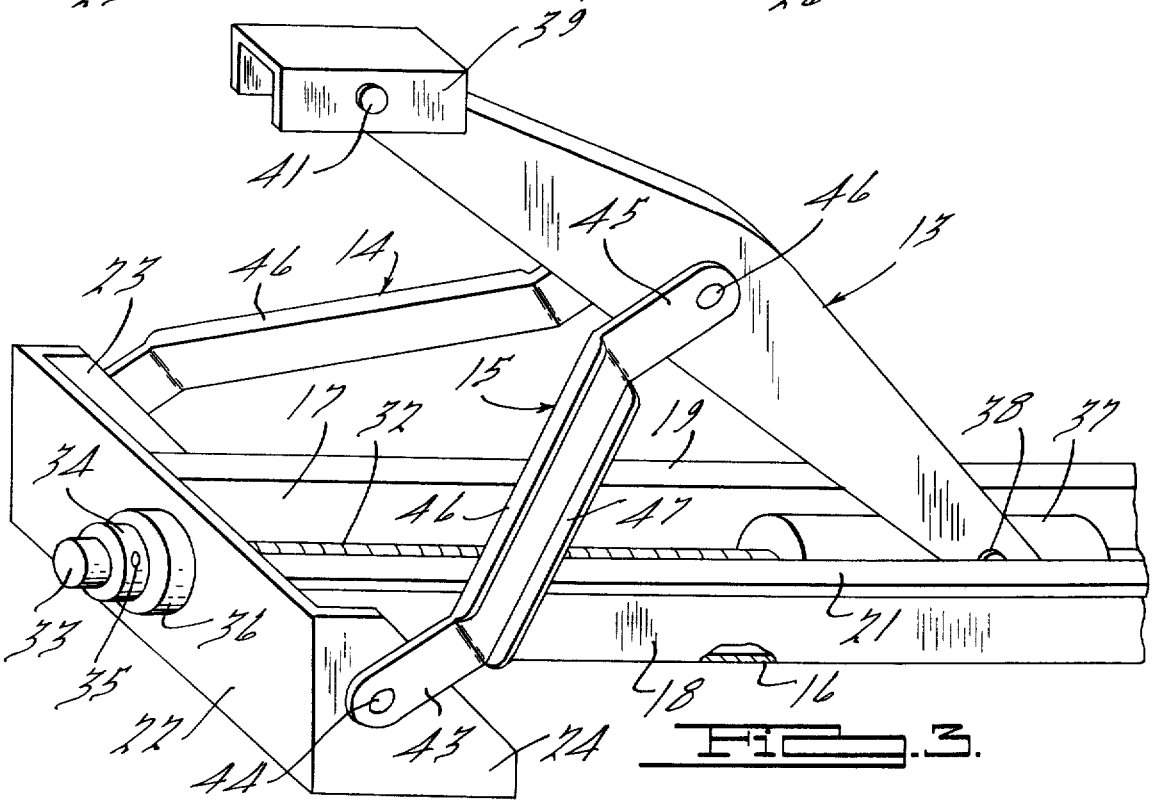
FIG. 3 is a fragmentary perspective view of one portion of the jack showing the relative configurations of the lifting arm and side levers.
Figure 4:
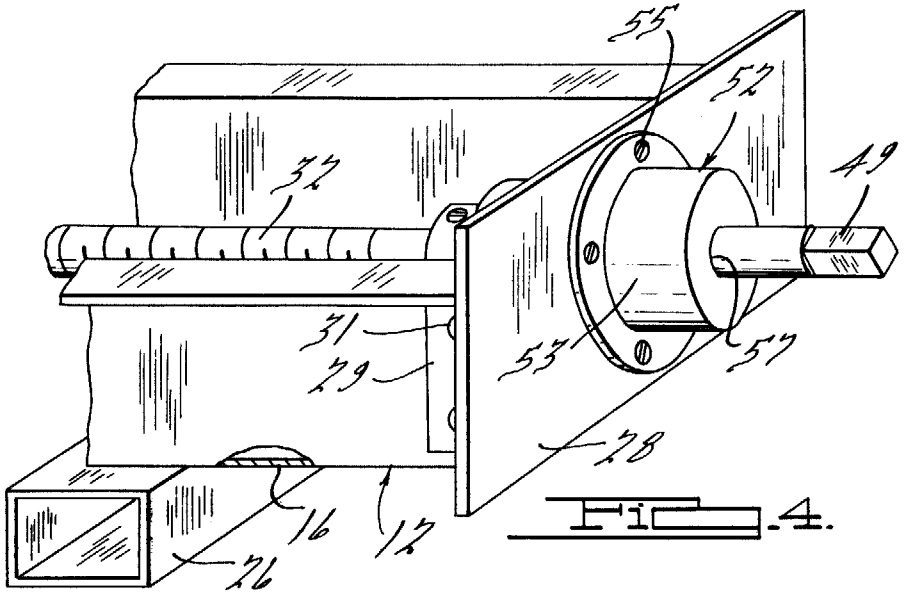
FIG. 4 is a fragmentary perspective view of the end portion of the jack having the crank connection and clutch for preventing inadvertent jack movement.
Figure 5:
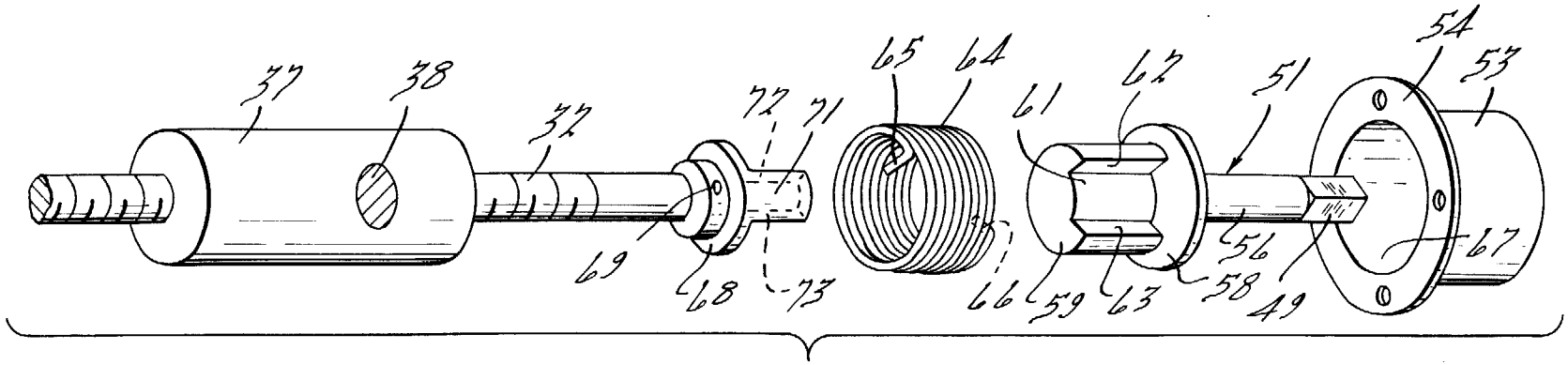
FIG. 5 is an exploded view of the clutch showing its elements.

Side levers 14 and 15 are each of bent shape as seen in FIG. 3, having one end 43 pivoted at 44 to flange 23 or 24 of thrust plate 22. The other end 45 of each side lever is pivoted at 46 to the intermediate portion of arm 13. The intermediate portions of levers 14 and 15 are reinforced by flanges 46 and 47.

Preferably, thrust plate 22 is of sufficient width as to impart stability to the jack. It will be observed that lifting pad 39, lifting arm 13 and side levers 14 and 15, together with their connecting parts, form a stable tripod arrangement.

The means for rotating shaft 32 may comprise a wrench indicated schematically in dot-dash lines at 48 which is removably applied to a square crank connection 49. This crank connection is part of an input element generally indicated at 51 of a self-locking clutch generally indicated at 52 mounted on clutch supporting plate 28. The construction of this clutch is seen best in FIGS. 5 and 6. The clutch has a housing 53 secured by a flange 54 and fasteners 55 to a central apertured portion of plate 28. Input element 51 comprises a shaft 56 extending through a central apertured portion 57 in the end of housing 52 and carrying crank connection 49 and its outer end. Input element 51 further comprises a thrust bearing portion 58, and extending from the thrust bearing portion is a cylindrical cartridge portion 59 with an arcuate cut-out 61 having radial shoulders 62 and 63.

Cartridge 59 extends into a helical coil spring 64 having inbent ends 65 and 66. The arrangement is such that spring end 65 is adjacent surface 62 of cartridge 59 and end 66 adjacent surface 63. The diameter of spring 64 is such that it normally lightly engages the cylindrical inner surface 67 of housing 53, or is adjacent thereto.

Shaft 32 carries a collar 68 disposed within housing 53 and attached to the shaft by a pin 69. Collar 68 has an axially extending tab 71 having radial walls 72 and 73. Tab 71 is disposed between spring ends 65 and 66 and within cut-out 61 of cartridge 59.

The arrangement is such that when shaft 32 is urged to rotate in either direction by an axial load applied to nut 37 through pivot pin 38, one surface 72 or 73 of tab 71 will engage the adjacent inbent end 65 or 66 of the spring. This will tend to expand the spring which will frictionally engage inner surface 67 of housing 53, preventing shaft 32 from rotating. However, when rotative forces are applied to input element 51 by means of wrench 48 acting as a crank, shoulder 62 or 63 of cartridge 59 will engage the adjacent spring end, contracting the spring and permitting it to freely rotate inside housing 53. The rotative force will be transmitted through the spring end to tab 71 and thus to shaft 32. Thus, load 42 resting on lifting pad 41 cannot drop inadvertently.

In operation, assuming an initial position as shown in FIG. 1 in which arm 13 and levers 14 and 15 are nearly horizontal, and load 42 resting on lifting pad 41, crank 48 will be placed on connection 49 and rotated to raise the load. During this movement, nut 37 will travel along shaft 32 and both arm 13 as well as side levers 14 and 15 will pivot upwardly, a raised position being shown in FIG. 2.

Because of the mechanical advantage afforded by threaded shaft 32 and the lever arrangement, a heavy load such as a portion of an automotive vehicle may be easily lifted by this method. The load will be held in position by self-locking clutch 52. Alternatively, clutch 52 may be omitted and the means for preventing shaft rotation by the load may comprise deliberate bearing friction which reduces the efficiency of the load lifting system to less than 50 percent.

Figure 7:
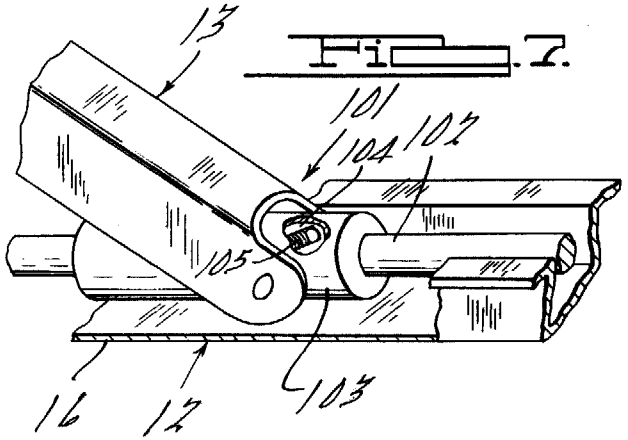
FIG. 7 shows a fragmentary perspective of a modified form of the invention using a threadless screw.
Figure 6:
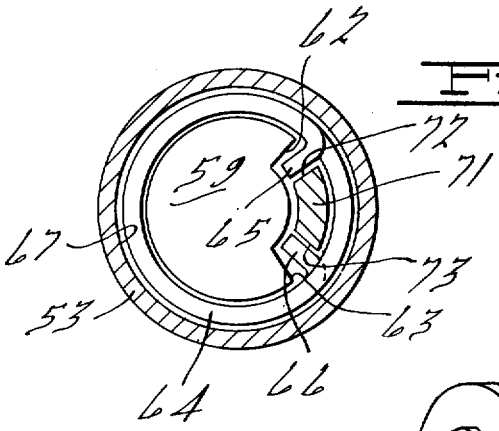
FIG. 6 is a cross-sectional view of the clutch.

FIG. 7 shows a modified form of the invention which is similar to that of FIGS. 1 through 6 but in which a feed mechanism of the type shown in my U.S. Pat. No. 3,081,639 is in place of the threaded shaft and nut. This feed mechanism is indicated generally at 101 and comprises a smooth shaft 102 comprising the inner race, a nut 103 comprising the outer race, and a cage 104 with inclined rollers 105 as more fully described in said patent.

Figure 8:
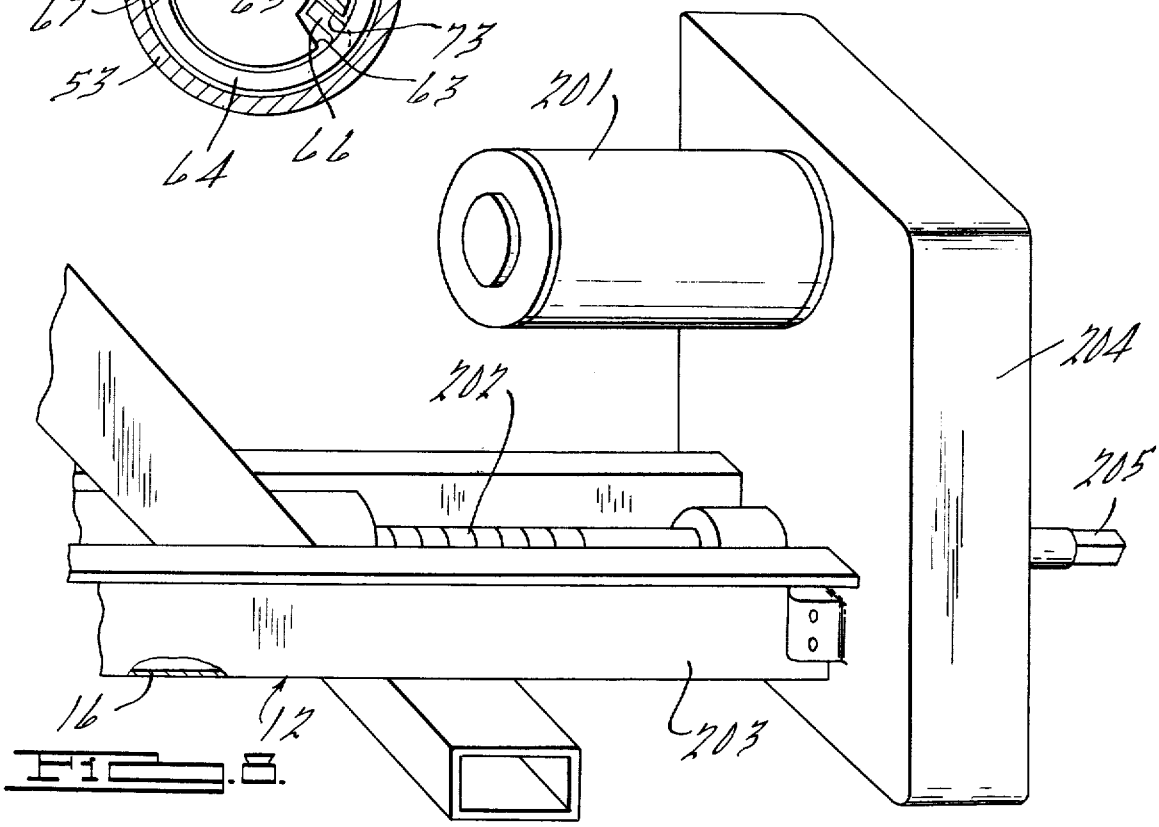
FIG. 8 is a fragmentary perspective view of a modified form of the invention in which a power operating means is used to drive the screw.

FIG. 8 illustrates a third embodiment of the invention which is basically similar to the first and second embodiments but has a rotary power unit 201 for driving shaft 202. Base 203 has a gear box 204 secured to one end thereof, the gear box containing gears (not shown) which connect power operating means 201 to shaft 202. Gear box 204 preferably contains means equivalent to self-locking clutch 52 for preventing a load on the lifting pad from rotating shaft 202. The power operating means may be electric, hydraulic or other rotatable means for obtaining torque. A crank connection 205 may also extend outwardly from gear box 204 to facilitate manual actuation of the jack as an alternate to power operation.

Figure 9:
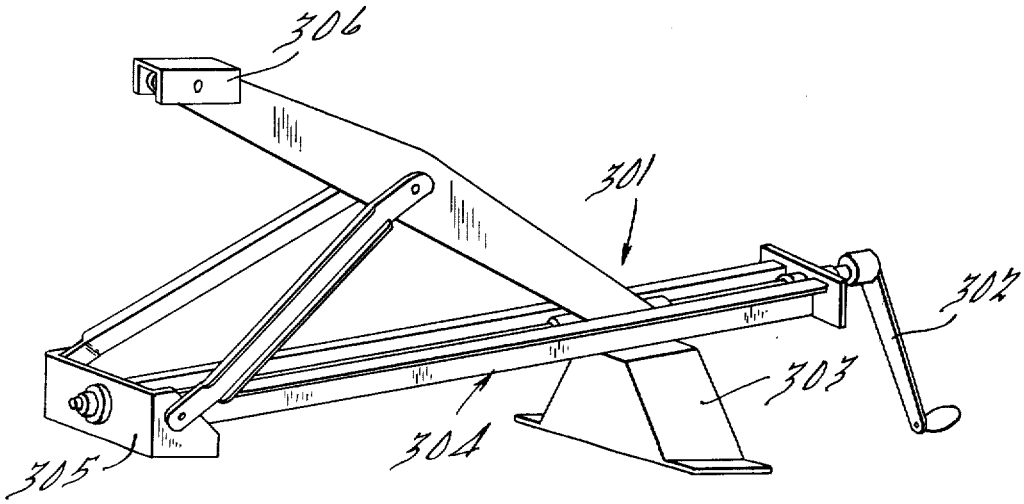
FIG. 9 is a perspective view of another modification of the invention which permits the direct attachment of a hand crank to the shaft drive and allows the crank to rotate continuously through a full 360°.

FIG. 9 shows a fourth embodiment of the invention basically similar to the other embodiments and generally indicated at 301, but is intended to permit continuous rotation of a crank 302. In this case, a foot 303 is provided in place of foot 26 of the previous embodiment, foot 303 being of substantially greater height so that base 304 is inclined upwardly from thrust plate 305. This will provide sufficient ground clearance so that crank 302 may be continuously rotated when raising or lowering lift pad 306.

I claim:

1. In an automobile chassis jack, an elongated base, a shaft extending along said base, a nut mounted on said shaft, means interconnecting said nut and shaft whereby rotation of said shaft will cause axial movement of the nut, a lifting arm pivotally connected at one end to said nut, a lifting pad pivotally mounted at the outer end of said lifting arm, a thrust plate mounted at one end of said base and extending transversely thereacross, a pair of side levers each having one end pivoted adjacent said thrust plate, the opposite ends of said side levers being pivotally connected to an intermediate portion of said lifting arm, means at the end of said base remote from said thrust plate for rotating said shaft in either direction, whereby said lifting pad may be moved between a raised position and a lowered position, the lifting pad in its lowered position being remote from said rotating means whereby the lifting pad may be placed beneath a chassis without the necessity of inserting intermediate portions of the jack beneath the chassis, and means for preventing a load on said lifting pad transmitted to said nut from rotating said shaft.

2. The combination according to claim 1, said thrust plate having portions extending laterally a substantial distance on opposite sides of said base, said side levers being connected adjacent the outer ends of said thrust plate and being bent inwardly toward said lifting arm said connections, said lifting arm being substantially narrower than said thrust plate, whereby the lift pad, lifting arm and side levers with their connecting parts form a tripod support for a load resting on the lifting pad.

3. The combination according to claim 1, said means for preventing rotation of said shaft by a load on said lifting pad comprising a self-locking clutch mounted on the end of said base opposite said thrust plate.

4. The combination according to claim 3, said shaft rotating means comprising an input element extending from said self-locking clutch and having a non-circular end to which a crank may be connected.

5. The combination according to claim 3, further provided with a clutch supporting plate secured to said opposite end of the base and carrying said self-locking clutch.

6. The combination according to claim 1, said shaft being threaded.

7. The combination according to claim 1, said shaft being smooth and comprising an inner race, said nut being cylindrical and comprising an outer race, said means interconnecting the shaft and nut comprising a cage with inclined rollers.

8. The combination according to claim 7, said shaft rotating means comprising a gear box mounted on said base and carrying a rotary power unit.

9. The combination according to claim 1, said thrust plate extending below said base, and a foot adjacent the opposite end of said base whereby the base will be parallel to the ground when the foot and thrust plate rest thereon.

10. The combination according to claim 1, said thrust plate having a portion extending below said base and resting on the ground and a foot adjacent the opposite end of said base and substantially higher than said last-mentioned portion of the thrust plate, whereby said base is inclined upwardly from the thrust plate, said shaft rotating means comprising a crank removably connectable to the shaft, the height of said foot being such that the crank may rotate continuously.

11. In a vehicle chassis jack, a base having a channel-shaped cross section with outwardly extending flanges, a thrust plate at one end of said base and extending transversely from both sides thereof, a portion of said thrust plate extending below said base and resting on the ground, a foot adjacent the opposite end of said base, a shaft extending along said base within the channel formed thereby, one end of said shaft extending through said thrust plate, a collar carried by said extending end of the shaft and engageable with thrust bearing means carried by the thrust plate, a nut mounted on the shaft, means connecting the nut and shaft whereby rotation of the shaft will cause the nut to travel axially, a lifting arm having one end pivotally connected to the nut, a lifting pad pivotally connected to the opposite end of said lifting arm, a pair of side levers, one end of each side lever being connected adjacent an outer end of said thrust plate, the side levers being bent inwardly with their opposite ends pivotally connected to an intermediate portion of said lifting arm, a clutch supporting plate mounted at the opposite end of said base, a self-locking clutch carried by said clutch plate, an input element mounted on said self-locking clutch carrying a non-circular crank connection adapted to removably receive a crank, and means connecting the output of said self-locking clutch to said shaft, the self-locking clutch being so constructed as to prevent rotation of said shaft by axial force exerted thereon by said nut.

* * * * *